United States Patent [19]

Obermeyer

[11] 4,448,315

[45] May 15, 1984

[54] STORAGE RACKS WITH SPACER TABS

[75] Inventor: James H. Obermeyer, Crown Point, Ind.

[73] Assignee: Unarco Industries, Inc., Chicago, Ill.

[21] Appl. No.: 321,045

[22] Filed: Nov. 13, 1981

[51] Int. Cl.[3] ..... A47F 5/00

[52] U.S. Cl. ..... 211/191; 403/13; 403/234

[58] Field of Search ..... 211/191, 190, 208, 187, 211/189, 192, 182; 248/165; 108/114; 403/234, 237, 13, 14

[56] References Cited

U.S. PATENT DOCUMENTS 3,095,975 7/1963 Cassel et al. ..... 211/192
3,266,635 8/1966 McConnell ..... 211/191

FOREIGN PATENT DOCUMENTS 921869 2/1973 Canada ..... 211/191
2447164 9/1980 France ..... 211/208

*Primary Examiner*—Ramon S. Britts
*Assistant Examiner*—Robert W. Gibson, Jr.
*Attorney, Agent, or Firm*—Clement and Ryan

[57] ABSTRACT

A storage rack with spaced tolerance control tabs which effectively minimize down-aisle space buildup. The control tabs are positioned along the length of the storage rack and extend from the angles of the beam assemblies. The control tabs of adjacent angles are positioned adjacent each other at generally the same vertical level, and may be in contact with each other, near the outer surface of the post. In the preferred form, each control tab is located generally midway along the upright edge of the angle from which it extends, is generally rectangular in shape, and has a length about 1/10 the length of the upright edge of the angle.

3 Claims, 6 Drawing Figures

FIG. 1
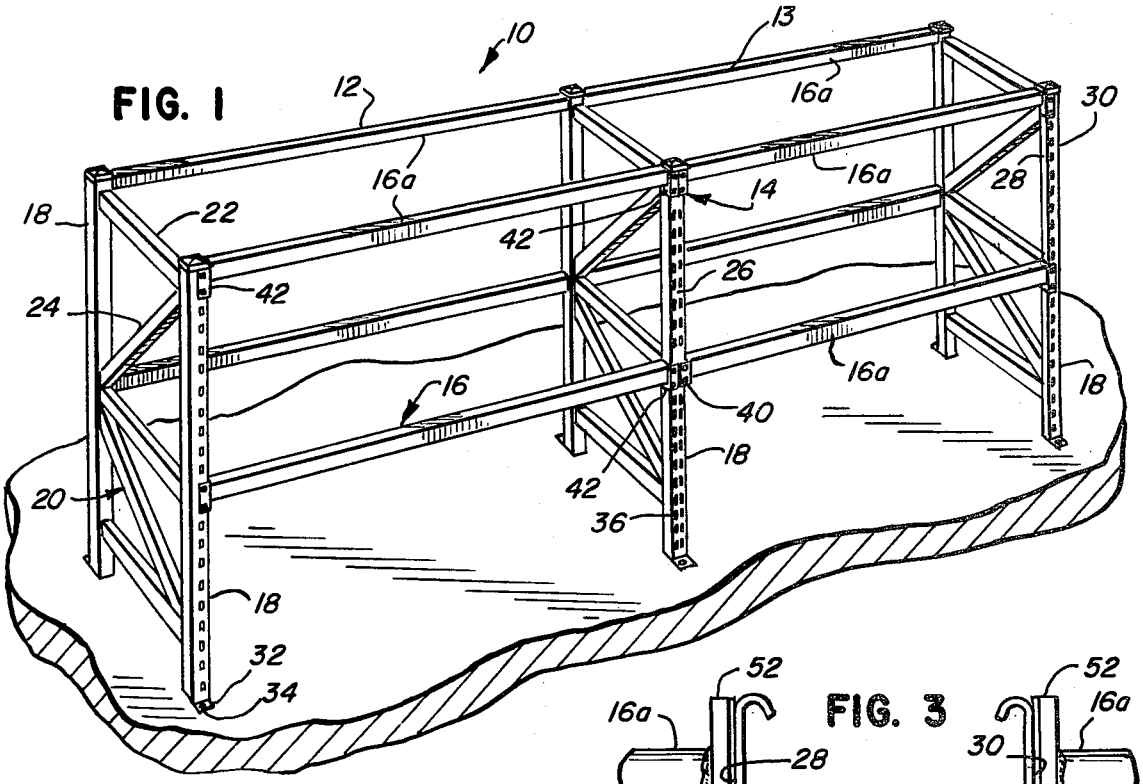
FIG. 3
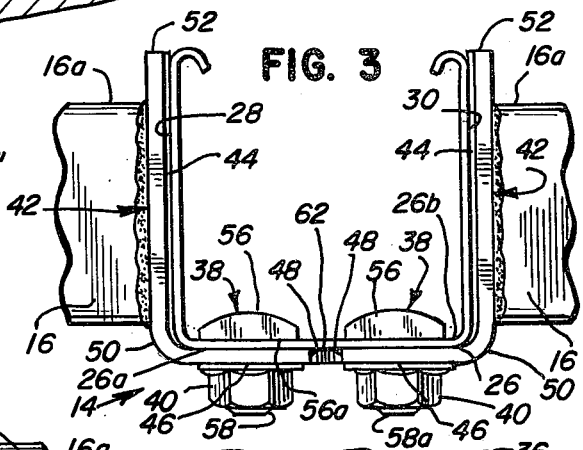
FIG. 5
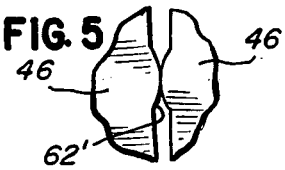
FIG. 6
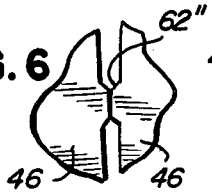
FIG. 4 PRIOR ART
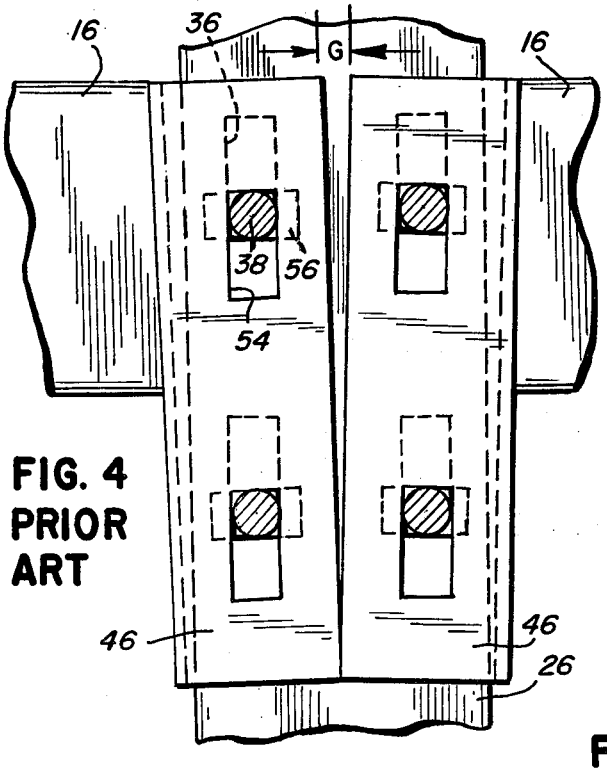
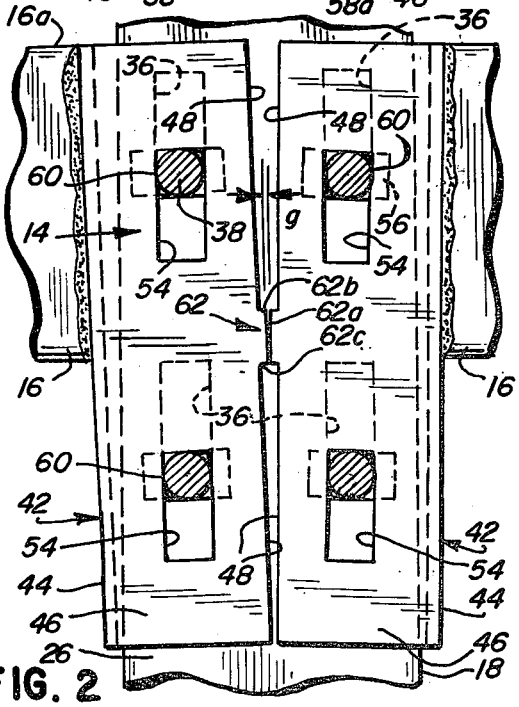
FIG. 2

STORAGE RACKS WITH SPACER TABS

DESCRIPTION

1. Technical Field of the Invention

This invention relates to storage racks, and more particularly to storage racks having tolerance control tabs or spacer tabs for controlling down-aisle space buildup in such racks having beam-supporting angles that are bolted to the upright posts of the rack, and to methods of erecting such storage racks.

2. Background of the Invention

Over the years a variety of storage racks have been developed with connectors that connect horizontal beams to upright posts. Usually, each end of the beam is welded to an angle which abuts against and is supported by the post. In one type of connector, nuts and bolts are inserted into apertures in the posts and angles to securely fasten the angles to the posts. The present type invention is designed and intended for use with storage racks utilizing nuts and bolts for connecting beam angles to the upright posts, or any other connector means in which some degree of "play" is provided between the upright posts and their associated beam angles when the latter are seated generally in their installed positions but the connector means has not yet been fully tightened.

In storage racks constructed according to the prior art, a condition commonly referred to as "down-aisle space buildup" sometimes interferes with proper assembly and installation of the storage rack. In this condition, variations or errors in the dimensions or positioning of certain elements that make up the storage rack accumulate as one moves down a row of upright posts—from one post and its associated horizontal beams and attached angles to the next post and its associated beams and angles—until the accumulated errors throw the system out of alignment.

As one example of such errors in the dimensions or positioning of elements that make up the storage rack, the longitudinal dimension of successive beams may vary significantly as one moves down the aisle upon which the storage rack faces. As another example, as one moves along the storage rack errors may be present in the horizontal spacing between adjacent apertures or slots of a given post in which the means that connect the horizontal beams to that post are received. As still another example, errors may be present in the width of the angles welded to the horizontal beams, or in the positioning of the apertures in those angles through which the means that connect the horizontal beams to the vertical posts are received. Finally, and perhaps most important, errors may be present in the angular positioning of the angles welded to the horizontal beams, in which case the bottom or top corners of adjacent angles may abut against each other at an angle to cause a larger gap between the edges of the angles than was contemplated in the design of the rack.

The apertured posts, beams, and angles of a given storage rack are fabricated and assembled so that the dimensions and positioning just indicated fall within certain tolerances with respect to the design specifications of the storage rack. The variations from those specifications that are present in a particular storage rack may or may not cause a problem. If the variations within the specified tolerances are all of substantially the same magnitude and happen to alternate, for example, between those that tend to add to the length of the rack as one moves down the aisle and those that tend to take away from the length of the rack, the cumulative effect of the variations will not throw the rack out of alignment.

However, if it happens that all the variations in question tend either to add to or take away from the length of the rack or the length of a series of beams at a given height, at some point down the aisle the cumulative effect of the variations will throw the rack out of alignment to an extent that interferes significantly with the installation and/or use of the rack. This condition, whether it adds to or takes away from the overall design length of a storage rack or from the overall design length of a series of beams at a particular level in the rack—that is, whether the cumulative effective is positive or negative—is typically referred to as "down-aisle space buildup."

Down-aisle space buildup can have several disadvantages. Down-aisle space buildup is critical, for example, if a storage rack is designed to be installed in a confined space, with each end of the rack abutting a confining wall or other structure. In such a case, a negative buildup will introduce an undesirable gap at one or both ends between the storage rack and the confining structures, and a positive buildup may make it impossible to fit the rack in place between the confining structures. Further, in many cases the anchoring means for the vertical posts of a storage rack are laid out and installed on the floor or deck before the rack is to be secured in place, and in any such case if the posts are thrown out of alignment because of down-aisle space buildup then it may be impossible to position the posts in their already installed anchoring means.

Finally, if there is a different degree of down-aisle space buildup for the series of beams at the various levels of a storage rack, it may be impossible, regardless of the amount of force employed, to fit the connectors for the beams at all levels into engagement with a particular vertical post. And even if the connectors can be forced into place in the slots or other apertures in a given post, the result may be that the beams at various heights force the vertical post into a tilted or distorted position, and thus a "snaking" condition is created that fails to meet the plumb specifications for the rack.

Any conditions such as those referred to which produce departures from the structure of the storage rack as designed can detract significantly from the proper installation or functioning of the rack. This is expecially true in the case of modern storage rack systems, which may be as much as several hundred feet long. In systems of such a size, not only is the possibility of down-aisle space buildup significantly increased, but the integrity and consistency of the sections that together make up the storage rack system are even more important to the proper functioning of the system than in the case of storage rack systems of shorter, more conventional length.

It is therefore desirable to provide a storage rack which minimizes down-aisle space buildup from whatever source that may arise.

SUMMARY OF THE INVENTION

A storage rack is provided by this invention that effectively minimizes down-aisle space buildup.

To this end, each beam assembly of the storage rack has a tolerance control tab or spacer tab that is fixedly secured to and extends from a portion, such as the angle, of a connector assembly. The control tab is located adjacent the outer surface of a post and abuts against or is otherwise adjacent to the control tab of an adjacent connector assembly. Each angle has a lateral plate that extends laterally across the beam and is positioned against an end surface of the post, and a longitudinal plate which is positioned against the outer surface of the post. Preferably, the control tab extends in a longitudinal direction, located generally at the midportion of the upright edge of the longitudinal plate. for a minor portion of the edge length. In the illustrative embodiment, the control tabs have a generally rectangular configuration.

In the preferred embodiment disclosed, the connector assembly includes nuts and bolts, preferably in the form of generally T-shaped bolts, to connect the angles to the posts.

A more detailed explanation of the invention is provided in the following description and appended claims taken in conjunction with the accompanying drawings.

BRIEF DESCRIPTION OF THE DRAWINGS

FIG. 1 is a perspective view of a storage rack in accordance with the principles of the present invention;

FIG. 2 is a front view of tolerance control tabs and other portions of the storage rack of the present invention;

FIG. 3 is a top view of the tolerance control tabs of FIG. 2 and other portions of the storage rack of the present invention;

FIG. 4 is an enlarged front view of portions of a prior art storage rack with the bottom corners of adjacent angles abutting each other at an angle so as to cause an enlarged gap between the upper edges of the angles, and depicting the bolts that attach the beam angles to the upright posts in cross section;

FIG. 5 is a fragmentary view showing an alternative embodiment of the tolerance control tabs utilized in this invention; and FIG. 6 is another fragmentary view showing an alternative embodiment of the tolerance control tabs utilized in this invention.

DETAILED DESCRIPTION OF THE PREFERRED EMBODIMENT

FIG. 1 of the drawings illustrates a storage rack 10 having adjacent storage rack sections or modules 12 and 13, respectively, connected in an end-to-end array by connector assemblies 14. The storage rack 10 is particularly useful for supporting load-carrying pallets, but can also be used for carrying other articles and loads. Additional storage rack sections or modules can be attached by the use of other connector assemblies 14.

Storage rack 10 is constructed of a plurality of elongated, generally horizontal load-carrying beam assemblies 16 that are connected via connector assemblies 14 to upright posts or columns 18 of upright frames 20. In the illustrative embodiment, each upright frame 20 has a plurality of horizontal crossbars 22 that extend laterally between and interconnect posts 18. Each upright frame 20 also has one or more diagonal braces 24 which connect the crossbars to provide additional lateral support for the storage rack 10. In some circumstances, it may also be desirable to mount supplementary horizontal crossbars, or a metal deck or fork entry bars upon the beam assembly 16 to provide further support for the load.

Each of the beam assemblies 16 has a generally horizontal tubular beam **16*a* that extends in the longitudinal direction. In the illustrative embodiment, beam 16*a* has a rectangular cross-sectional configuration. Beams with other cross-sectional configurations can also be used. Preferably, beams 16*a*, posts 18, and other parts of storage rack 10** are made of metal, such as steel.

In the illustrative embodiment, each upright post 18 is channel-shaped with an open side facing towards the interior of storage rack 10. Each post 18 has an outer surface 26 (FIGS. 1, 2 and 3) that extends between and connects a pair of end surfaces 28 and 30 (FIGS. 1 and 3). The outer surface 26 extends generally in the longitudinal direction measured along the length of storage rack 10. End surfaces 28 and 30 are positioned in parallel relationship to each other and extend in a lateral direction generally transverse to the length of storage rack 10. Outer surface 26 has an outer post surface **26*a* (FIG. 3) that faces generally away from the interior of the storage rack 10 and an inner post surface 26*b* (FIG. 3) that partly bounds the interior of the post 18 and faces generally towards the interior of storage rack 10. Each of the faces 26, 28, and 30 of posts 18 are generally planar or flat and are positioned vertically. A foot plate 32 (FIG. 1) having holes 34 for anchor bolting is welded at the bottom of each post 18**. Posts having other shapes and configurations such as closed tubular posts can also be used.

The outer surface 26 (FIGS. 1 and 2) of each post defines a plurality of T-bolt receiving slots or apertures 36 (FIGS. 1 and 2). In the illustrative embodiment, each post has two sets of vertically aligned rectangular slots 36 with the elongated parallel sides of the slots positioned generally vertically. While rectangular post slots 36 are preferred, it may be desirable in some circumstances to use post slots having different configurations.

Connector assemblies 14 (FIGS. 1, 2 and 3) which connect beam assemblies 16 to posts 18 include at least one, and preferably two, generally T-shaped bolts 38 (FIG. 3), nuts 40, and an angle 42 securely connected such as by welding, to the end of each beam **16*a*. Angles 42 at the end of each beam 16*a* are aligned in horizontal registration and are symmetrical with each other. Each angle 42 is L-shaped with a generally planar or flat lateral plate 44 (FIG. 3) extending across and secured to the end of beam 16 a for positioning against one of the end surfaces 28 or 30 of a post 18, and a generally planar or flat longitudinal plate 46 (FIG. 3) that extends in the longitudinal direction for positioning against outer surface 26 of post 18**.

In the illustrative embodiment, lateral plate 44 extends substantially across end surface 28 or 30 of post 18, while longitudinal plate 46 extends less than one-half the maximum span of outer surface 26 of post 18 taken in the longitudinal direction. Longitudinal plate 46 terminates in an upright edge 48 (FIGS. 2 and 3), and has a maximum span in the longitudinal direction from upright edge 48 to corner 50 (FIG. 3) of angle 42. Lateral plate 44 has a maximum span in the lateral direction that extends from corner 50 to the vertical terminal edge 52 of lateral plate 44. In the illustrative embodiment, angle 42 is made of 7-gauge steel. Angles having other gauge thicknesses can also be used.

Longitudinal plate 46 of angle 42 defines at least one, and preferably two, vertically aligned T-bolt receiving slots or apertures 54 (FIG. 3) which are adapted to be aligned in registration with corresponding post slots 36.

T-shaped bolts 38 (FIG. 3) which are inserted into the aligned angle slots 54 and post slots 36 have a tee head 56 (FIG. 3), an elongated externally threaded shank 58, and a neck 60 (FIG. 2). Tee head 56 has a generally planar or flat underside 56*a* that interlockingly engages and abuts against inner post surface 26*b*. Shank 58 extends in the lateral direction when installed and has a terminal end 58*a* (FIG. 3) located outwardly of the outer post surface 26*a*.

In the preferred embodiment, T-bolt 38 is torque responsive and receives at least a portion of the torque applied to nut 40 with which it is engaged, so that it rotates at least some angular distance with nut 40 as the nut is turned before a predetermined torque applied to the nut has been exceeded. Shank 58 receives at least a portion of the torque applied to nut 40 and turns together with the nut for at least some angular distance before a predetermined torque has been applied to the nut. While torque-responsive bolts are preferred, in some circumstances it may be desirable to use other types of bolts.

Tee head 56 of bolt 38 has outwardly extending portions that extend outwardly of neck 60 a predetermined distance in opposite directions. The span of tee head 56 is less than the height of post slot 36 so that it can be inserted into the slot, but is greater than the width of post slot 36 so that it will interlockingly engage and abut against inner post surface 26*b* (FIG. 4) after it is rotated 90 degrees. The maximum width of tee head 56 does not extend outwardly of neck 60 (FIG. 2) as viewed in a direction generally normal (perpendicular) to the direction of the outwardly extending portions of tee head 56.

The cross section of neck 60 of T-bolt 38 is "semi-square" in configuration, by which is meant a cross section having four sides of generally equal length, the opposite sides of the cross section being parallel to each other, and the four sides intersecting to form a first set of diagonally opposite corners each of which is arcuate, and a second set of diagonally opposite square corners. The cross section is symmetrical along the line bisecting either pair of diagonally opposite corners, and can also be characterized as being generally lenticular in shape.

Semi-square neck 60 is slightly smaller in its minimum thickness than the width of slot 54, but the maximum distance between the most widely spaced opposite corners is substantially more than the width of that slot. The distance between any two diagonally opposite corners of the cross section of the semi-square neck is substantially less than the maximum overall length of the extending portions of tee head 56. It follows that the wall portions defining post slot 36 will snugly receive and abuttingly engage semi-square neck 60 when the tee-head is rotated 90 degrees to a position transverse to the vertical sides of the post slot.

The length of semi-square neck 60 (FIG. 2) taken along the longitudinal axis of the bolt is a function of the thickness of longitudinal plate 46 of angle 42 and outer surface 26 of post 18. In the preferred form, the length of semi-square neck 60 is about equal to the combined thickness of the angle's longitudinal plate 46 and the outer wall of post 18.

Internally threaded nuts 40 (FIG. 3) threadingly engage threaded shank 58 of T-bolt 38, and when tightened are positioned against the outer surface of the beam angle's longitudinal plate 46. In the illustrative embodiment, nuts 40 preferably take the form of prevailing torque lock nuts such as the type shown in U.S. Pat. Nos. 3,496,582 and 3,340,920 or sold under the trademark "Ovalox" by Russell, Burdsall and Ward, Inc. Prevailing torque lock nuts 40 have deformed threads which can be readily started on bolts 38, but which interlockingly engage the bolts 38 after the lock nuts have been turned beyond a predermined angular distance on the bolts 38. Each prevailing torque lock nut 40 transmits to its bolt 38 at least a portion of the torque that is applied to it by a torque applying tool, such as a power wrench or the like, so that the bolt 38 will turn for at least some angular distance with its nut 40 as the nut 40 is turned. Prevailing torque lock nut 40 provides good resistance to loosening from vibration and shock.

In the embodiment shown, each prevailing torque lock nut 40 derives its locking ability from controlled deformation of the outer portion of its internal threads so that the threaded hole gradually changes from a true round shape at its bearing face to an elliptical shape at its outer end. The round threaded hole in the undeformed lower portion of the nut 40 allows the lock nut 40 to be started easily on the bolt 38. Turning of the lock nut 40 beyond a predetermined torque deflects the deformed threads of the lock nut 40 to the shape of the bolt and creates a frictional drag and an interlocking connection with the bolt 38. While prevailing torque lock nuts are preferably used, other types of nuts can also be used.

In order to minimize down-aisle space buildup of adjacent storage rack sections, each of the angles 42 has a tolerance control tab or spacer tab 62 (FIG. 2) that is fixedly secured and extends longitudinally away from the upright edge 48 of the beam angle's longitudinal plate 46. In the illustrative embodiment, tolerance control tab 62 has a generally rectangular configuration and extends integrally from the longitudinal plate generally at the midportion of the latter member's upright edge 48. Tab 62 has a generally C-shaped profile with a vertical abutment edge 62*a* extending between and connecting top and bottom longitudinal edges 62*b* and 62*c*, respectively. The junctions of the top and bottom edges 62*b* and 62*c* with the upright edge 48 of the longitudinal plate 46 are rounded to provide for stress relief.

In the illustrative embodiment, the height of the tab's vertical edge 62*a* is about $\frac{3}{4}$ inch, while the width of the tab's edges 62*b* and 62*c* are each about $\frac{1}{8}$ inch, so that the vertical edge 62*a* is about six times longer than the width of the tab's edges 62*b* and 62*c*. The length of the tab's vertical edge 62*a* is a minor fraction of the over-all length of the longitudinal plate's upright edge 48 (FIG. 2). In the illustrative embodiment the former dimension is about eight inches, so that the length of tab edge 62*a* is about 3/32 of the height of the longitudinal plate's upright edge 48. The preferred ratio of the length of the tab's vertical edge 62 to the over-all length of the longitudinal plate's upright edge 48 is about 1:10.

While tabs 62 having the proportional relationships, dimensions, and configurations are preferred, tabs having other proportional relationships, dimensions or configurations, such as arcuate tabs 62'(FIG. 5), trapezoidal tabs 62''(FIG. 6), etc., can also be used. Furthermore, while angles with a single tab are preferred, it may be desirable in some circumstances to use angles with more than one tab.

Each tab 62 is generally planar or flat and lies in a common plane with the longitudinal plate 46 from which it extends so that it is in coplanar relationship with the angle's longitudinal plate 46. When installed, tab 62 lies flush against the outer post surface 26*a*. The vertical edges 62*a* of the tab 62 of adjacent angles 42 are positioned adjacent each other at generally the same vertical level, and preferably abut against and engage each other, to keep down-aisle buildup (in a manner to be described) within an acceptable tolerance level.

Assembly

To assemble storage rack 10, nuts 40 and bolts 38 are preassembled and connected to the angle's longitudinal plates 46 to form preassembled angle assemblies. In this condition, semi-square neck 60 of T-bolt 38 is positioned in slot 54 of angle 42 with tee head 56 inward of inwardly facing surface of longitudinal plate 46, and nut 40 is turned on the bolt's threaded shank 58 so that the nut abuts against the outer surface of longitudinal plate 46.

After preassembling the angle assemblies, each beam 16*a* is positioned horizontally so that its angle slots 54 are aligned in registration with post slots 36. Tee head 56 of the bolt of each preassembled angle assembly is then inserted into its corresponding post slot 36 until the tee head is positioned inwardly of the inner post surface 26*b*. Thereafter, a torque is applied to the nut 40 by a power wrench or the like in an amount greater than the predetermined preassembly torque. A portion of the applied torque will be applied by nut 40 to bolt 38 and cause bolt 38 to rotate in unison with the nut for about 90 degrees until the bolt's semi-square neck 60 is firmly seated and engaged in the angle's slot 54, and the extending portions of tee head 56 are positioned transverse to the vertical edges of post slot 36.

Thereafter, nut 40 is tightened on bolt 38 until the underside of the tee head 56 firmly and securely engages the inner post surface 26*b* to form a secure, strong, and rigid connection between the post 18 and beam assembly 16. When nut 40 is tightened on bolt 38 after the bolt's neck 60 is seated in the angle slot 54, bolt 38 is thereafter prevented from rotating because of the interlocking cooperation between the bolt's semi-square neck 60 and the angle's slot 54.

If desired, the storage rack may be anchored to the floor or deck to increase the stability of the rack and avoid accidental displacement from its original position. For this purpose, anchoring devices may be secured to the floor or deck and foot plates 32 (FIG. 1) may be bolted thereto by use of holes 34 in the foot plates.

When the storage rack has been thus assembled, control tabs 62 of adjacent angles 42 are adjacent to or abuttingly engage each other, with results to be described below.

Avoiding and Correcting For Down-Aisle Buildup

As pointed out above, there are four possible sources of error in the dimensions and positioning of the various members that together make up a storage rack. These sources of error are possible variations in any or all of the following four parameters: (1) beam length, (2) the horizontal spacing between the slots at a given level in a particular upright post, (3) the width of the angles secured to the ends of the respective horizontal beams, and (4) the positioning of the angles with respect to the longitudinal axis of the beam with which they are associated.

The manufacturing specifications for the indicated dimensions ordinarily call for tolerances of plus or minus 1/64 inch, but in practice the variations often turn out to be as much as plus or minus 1/16 inch. The manufacturing specifications for the positioning of the angles with respect to the longitudinal axis of the beams ordinarily call for tolerances within a very small variation from a right angle, but in practice the variations for this positioning may turn out to be substantially greater. If these variations in dimensions and positioning accumulate as one moves down the aisle on which the storage rack faces, the resulting misalignment of the array of succeeding storage rack sections may be quite serious, and may result in the undesirable consequences described above in this specification.

The present invention avoids these undesirable effects by focusing attention on the control and utilization—in several ways—of a single parameter in place of the four parameters that need to be controlled in the storage racks of the prior art. This single parameter is the dimension measured from the outer edge of one tolerance control tab or spacer tab 62 at one end of a horizontal beam 16 to the outer edge of the similar tab 62 at the other end of the same beam.

For one thing, it has been found that this dimension can be controlled with a considerable degree of reliability within a tolerance of plus or minus 1/32 inch. This degree of reproducibility is not only much greater than what is provided in storage racks constructed in accordance with the prior art, but is much easier to achieve. The fabrication of the beam and its associated angles can usually be carried out in a manner that will assure that the described distance from spacer tab edge to spacer tab edge will not fall short of the specified distance by more than 1/32 inch. On the other hand, if the described distance turns out to be more than 1/32 inch too great, the beam can be quickly and easily brought within the tolerance just referred to by simply grinding down one or both spacer tabs, for example, with a disk grinder to remove enough mass that the dimension in question is no more than 1/32 inch too great.

The failure to weld angle 42 to the end of beam 16 at an angle of exactly 90° presents a special problem, which is illustrated in FIG. 4 of the drawing. As seen from that figure, if the angles are misaligned so that the corners of the angles abut each other at the bottom portions thereof, a gap "G" is produced at the top portions which may be quite large. (A similar gap will be produced between the bottom portions of the adjacent beam angles, of course, if the angles are misaligned so that their corners abut each other at the top portions thereof.) As seen from FIG. 2, the use of spacer tabs 62 of this invention will produce a much smaller gap "g" because of any misalignment of the beam angles. This is one reason that the spacer tabs of this invention are useful in minimizing, or avoiding altogether, troublesome down-aisle buildup.

Still other ways in which the spacer tabs of this invention can be utilized to cope with down-aisle space buildup are available after the storage rack has been set up in a preliminary manner and before the connecting means has been finally tightened to put the rack in its completed condition. Even though, as pointed out above, the distance from the edge of the spacer tab 62 at one end of a horizontal beam 16 to the edge of the spacer tab 62 at the other end of the beam can be controlled relatively easily to fall within quite small tolerances, various unavoidable structural deviations—whether deviations from the specified floor or deck locations for the post anchoring devices, or the accumulated effect of a large number of successive minor dimensional deviations in one direction, or deviations in the positioning of one or more angles with respect to their associated beams—may nevertheless still present a problem of either positive or negative buildup if the storage rack system extends for some considerable length. These problems may be dealt with by various techniques that utilize the spacer tabs of this invention, so long as there is some "play" provided between the upright posts and their associated beam assemblies when the connectors utilized have not yet been fully tightened.

If it is necessary to correct for positive down-aisle space buildup, either one of two techniques may be employed. In the first of these methods, the following four steps may be followed: (1) both sets of bolts securing the beam angles to the upright post are loosened; (2) one spacer tab is placed over the other, (3) a C-clamp is used to draw the beam angles together until the beams are in their proper positions with respect to each other; and (4) the connecting bolts are then tightened until both angles are snug against their associated post, with one spacer tab bent out of its original plane to accommodate the tight fit. (This technique is made possible by the fact that the spacer tab has a length that is only a small fraction of the length of the upright edge of the beam angle to which it is attached, and thus can be bent by mere tightening of the connecting bolts.) The second method is simply to grind off, as by use of a conventional disk grinder, the excess mass of one or both of the spacer tabs that interferes with the proper positioning of the adjacent beams.

If it is necessary to correct for negative down-aisle space buildup which makes it difficult to position adjacent horizontal beams properly, this can be compensated for by a three-step method: (1) both sets of bolts securing the beam angles to the upright post are loosened; (2) the beam angles of adjacent horizontal beams are spread apart the necessary distance (perhaps 1/16 inch or ⅛ inch) by driving a chisel or a wedge, for example, between the two beam angles; and (3) the connecting bolts are then tightened while the horizontal beams are held spread apart in their desired positions. If desired, in this method the wedge used may be adapted to be left in place in the installed rack.

It will be seen that the spacer tabs of this invention make it possible both (1) to minimize undesirable down-aisle space buildup (whether positive or negative) and, (2) when it is made necessary because of the circumstances, to correct for unavoidable buildup (again, whether positive or negative) in a simple and convenient way.

The preceding detailed description has been given for ease of understanding only. No unnecessary limitations should be understood therefrom, as modifications will be obvious to those skilled in the art.

What is claimed is:

1. A storage rack which comprises:

a generally upright post having a pair of end surfaces facing in opposite directions along the longitudinal axis of the storage rack, and an outer surface extending between and connecting said end surfaces;

a first beam assembly having a first elongated, generally horizontal beam extending in one direction along said longitudinal axis, a first connector assembly fixedly secured to one end of said first beam for connecting said first beam to said post, and a first tolerance control tab fixedly secured to said first connector assembly at a location generally adjacent said outer surface of said post; and a second beam assembly having a second elongated generally horizontal beam extending in the direction opposite to said one direction along said longitudinal axis, a second connector assembly fixedly secured by second connector means to one end of said second beam for connecting said second beam to said post, and a second tolerance control tab fixedly secured to said second connector assembly at a location generally adjacent said outer surface of said post, said first and second connector assemblies being spaced from each other and said first and second tolerance control tabs being positioned adjacent each other at generally the same vertical level, some degree of play being provided between said first and second connector assemblies and their associated upright post when said connector assemblies are seated generally in their installed positions but are not yet fully tightened, said first and second tolerance control tabs abuttingly engaging each other when said connector assemblies are tightened in their final installed positions.

2. A storage rack in accordance with claim 1 wherein said tolerance control tab has a generally arcuate shape.

3. A storage rack which comprises:

a plurality of adjacent storage rack sections connected in an end-to-end array, each of said storage rack sections having at least one generally upright frame and a plurality of generally horizontal beam assemblies, said upright frame having a plurality of generally upright posts, a plurality of generally horizontal crossbars extending laterally between and interconnecting said posts, and at least one diagonal brace connecting said crossbars for providing lateral support of said upright frame, each of said posts having a pair of generally parallel end surfaces facing in opposite directions along the longitudinal axis of the storage rack and an outer surface facing away from the interior of said storage rack and extending between and connecting said parallel end surfaces generally along said longitudinal axis, each of said beam assemblies having a generally horizontal beam extending along said longitudinal axis, a connector assembly at each end of said beam having an angle with a lateral plate extending across and secured to said beam for positioning against one of said end surfaces of one of said posts and a longitudinal plate for positioning against said outer surface of said post, said longitudinal plate having a generally upright edge and a generally rectangular tolerance control tab extending longitudinally from said upright edge generally at the midportion of said edge, each pair of adjacent storage rack sections having pairs of said horizontal beam assemblies positioned in general horizontal alignment with each other with the adjacent angles of each pair of horizontal beam assemblies engaging the same post, said upright edges of said adjacent angles being spaced from each other and having portions lying flush against and engaging the outer surface of said post, and said rectangular tolerance control tabs of said adjacent angles being positioned adjacent each other at generally the same vertical level, some degree of play being provided between said connector assemblies and the posts with which they are associated when said connector assemblies are seated generally in their installed positions but are not yet fully tightened, said first and second tolerance control tabs associated with said longitudinal plates on at least one of said pairs of aligned horizontal beam assemblies abuttingly engaging each other when said connector assemblies are tightened in their final installed positions.

* * * * *